US005184976A

United States Patent [19]

Babin

[11] Patent Number: 5,184,976

[45] Date of Patent: Feb. 9, 1993

[54] AIR CONDITIONING APPARATUS, PARTICULARLY FOR RAIL VEHICLES

[75] Inventor: James Babin, Sartrouville, France

[73] Assignee: Faiveley Transport, Saint Ouen, France

[21] Appl. No.: 638,457

[22] Filed: Jan. 7, 1991

[30] Foreign Application Priority Data

Jan. 5. 1990 [FR] France ..... 90 00081

[51] Int. Cl.[5] ..... B61D 27/00

[52] U.S. Cl. ..... 454/108; 454/287

[58] Field of Search ..... 454/76, 108, 112, 152, 454/287, 288

[56] References Cited

U.S. PATENT DOCUMENTS 2,774,227 12/1956 Schjolin et al. ..... 454/108 X
4,580,486 4/1986 Schulz ..... 454/108

FOREIGN PATENT DOCUMENTS 2398629 2/1979 France .
2461606 2/1981 France .
2632593 12/1989 France .

*Primary Examiner*—Harold Joyce
*Attorney, Agent, or Firm*—Young & Thompson

[57] ABSTRACT

The air conditioning apparatus, particularly for rail vehicles, comprises a ventilator (1) which blows conditioned air into a distribution conduit (2). This conduit (2) permits distribution of the air in a direction (x—x') pointing both inwardly and toward the floor (P) of the vehicle, thanks to a series of openings (4) provided on the lateral surface (5) and a series of orifices (6) located facing the openings (4) on an inclined wall (6) located within the conduit (2), and behind the series of openings (4). The securement of the covering (9) on the conduit (2) is insured simply by elements having a supplemental finishing function.

9 Claims, 3 Drawing Sheets

AIR CONDITIONING APPARATUS, PARTICULARLY FOR RAIL VEHICLES

FIELD OF THE INVENTION

The present invention relates to apparatus for air conditioning vehicles, particularly rail cars.

BACKGROUND OF THE INVENTION

French patent application 2 632 593 of the applicant describes an apparatus comprising a ventilator which blows cold or hot air into a conduit extending along the lower portion of the internal lateral surface of the vehicle. This conduit empties into two air outlet passages, the first being situated against the lateral surface of the conduit adjacent the interior of the vehicle and ensuring a distribution of air downwardly perpendicular to the floor of the vehicle, and the second being located above the conduit against the internal lateral surface of the vehicle and ensuring a distribution of air at the level of the windows. This second air passage is provided, at its base, with an opening adapted to cause air from the vehicle to enter the passage so as to improve the flow rate of the apparatus by convection.

This installation has several drawbacks, particularly as to the distribution of cold or heated air in the direction of the floor.

In the first place, the air passage located in the lower portion of the apparatus and ensuring blowing toward the ground has size problems, because it is juxtaposed to the conduit, and weight problems, the more so because its fragility, particularly as to the impact of traveler's feet, requires providing it with rigidifying members.

On the other hand, this apparatus requires, to effectively direct the air toward the ground, the use of deflector plates. When the blown air is reflected from these plates, its speed decreases and there is a reduction of flow.

Moreover, this flow depends also on the section of the air outlet zone and, as aesthetic considerations often require that the conduit be covered by a covering, this section is reduced by the thickness of this covering, particularly in the case of a pile fabric.

Finally, as this apparatus blows air downwardly perpendicular to the floor, there will be on the one hand a poor distribution of this air, particularly toward the middle of the vehicle and on the other hand a reflection from the floor. This reflection has the result of sending the air back in the direction of the upper part of the conduit and particularly toward the opening which normally receives air at the ambient temperature of the vehicle, which causes a loss of efficiency.

OBJECT OF THE INVENTION

The present invention has for its object overcoming these drawbacks so as to optimize the efficiency of the installation while ensuring maximum comfort to the passengers and at the same time improving the performance as to size and weight.

SUMMARY OF THE INVENTION

The apparatus which is the object of the invention comprises at least one ventilator blowing cold or reheated air into a conduit extending along the lower interior lateral surface of the vehicle, this conduit emptying into distribution means of the air toward the interior of the vehicle, said means comprising at least one opening provided on the lateral surface of the conduit adjacent the interior of the vehicle.

According to the invention, the apparatus is characterized in that this opening is provided in a plane which coincides with said lateral surface of the conduit, in that the interior of the conduit has, facing said opening, a wall forming an acute angle with said lateral surface of the conduit and connecting to the latter at a point located above said opening, said wall comprising at least one orifice located facing said opening, and in that the axis passing through the centers of said orifice and said opening points obliquely both toward the interior and toward the floor of the vehicle.

The apparatus permits blowing conditioned air in an oblique direction relative to the floor. As a result, the passengers are not disturbed by the passage of air and there are avoided the problems of loss of efficiency due to the flattening of the air jet against the floor. These characteristics of the air conditioned vehicle can on the other hand be easily taken account of by the choice of the height and the cross section of the openings on the lateral surface of the conduit and of the angle to this surface of the wall located within the conduit.

Moreover, the present apparatus has the advantage of being inconspicuous because the distribution means do not form projections on the surface of the conduit and because the exterior covering of the conduit can be easily applied to the apparatus.

Other features and advantages of the invention will become apparent from the following detailed description.

BRIEF DESCRIPTION OF THE DRAWINGS

In the accompanying drawings, given by way of non-limiting examples.

DETAILED DESCRIPTION OF THE INVENTION

Figure 1:
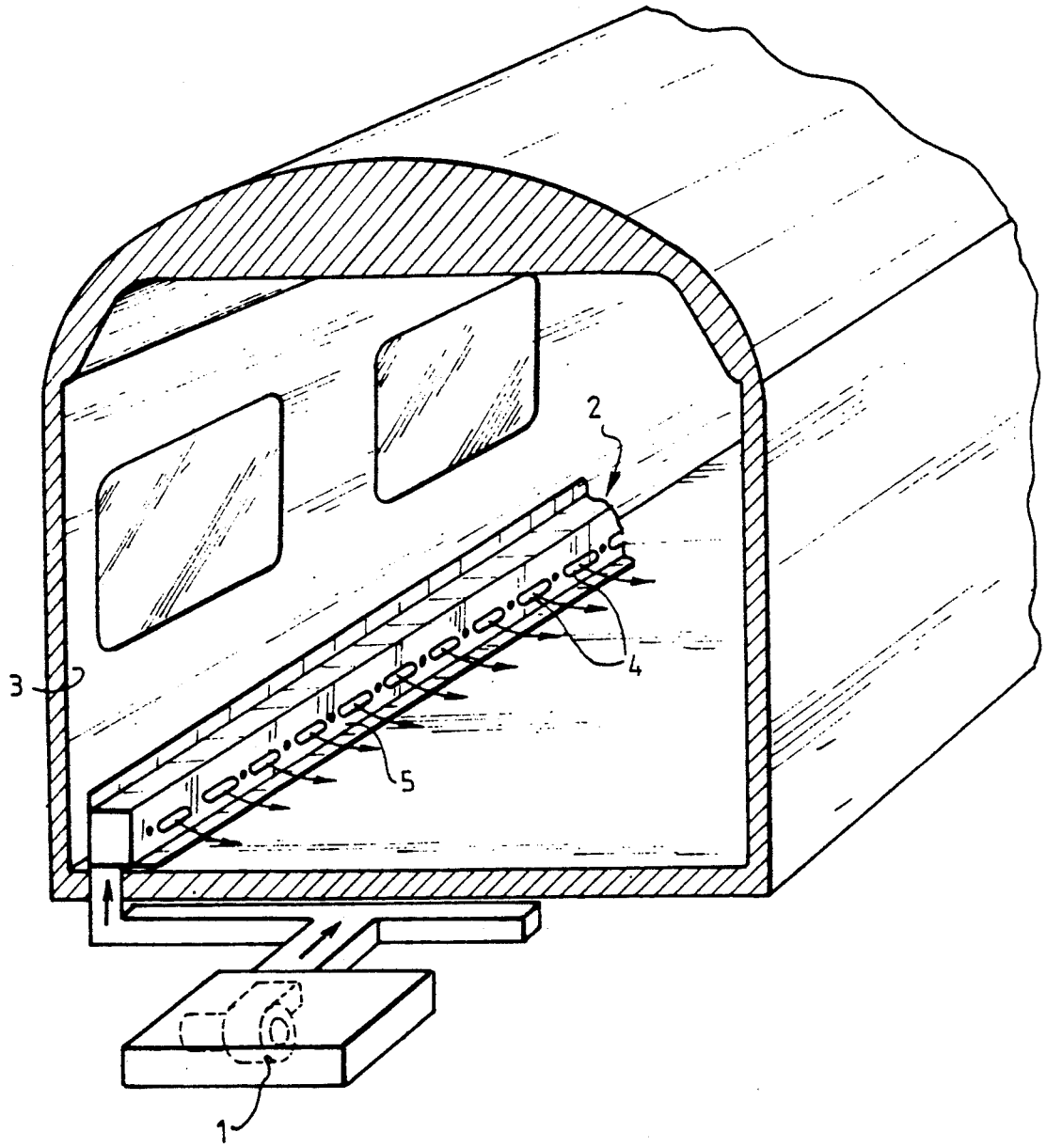
FIG. 1 is a schematic view of the air conditioning device according to the invention installed in a rail vehicle.
Figure 2:
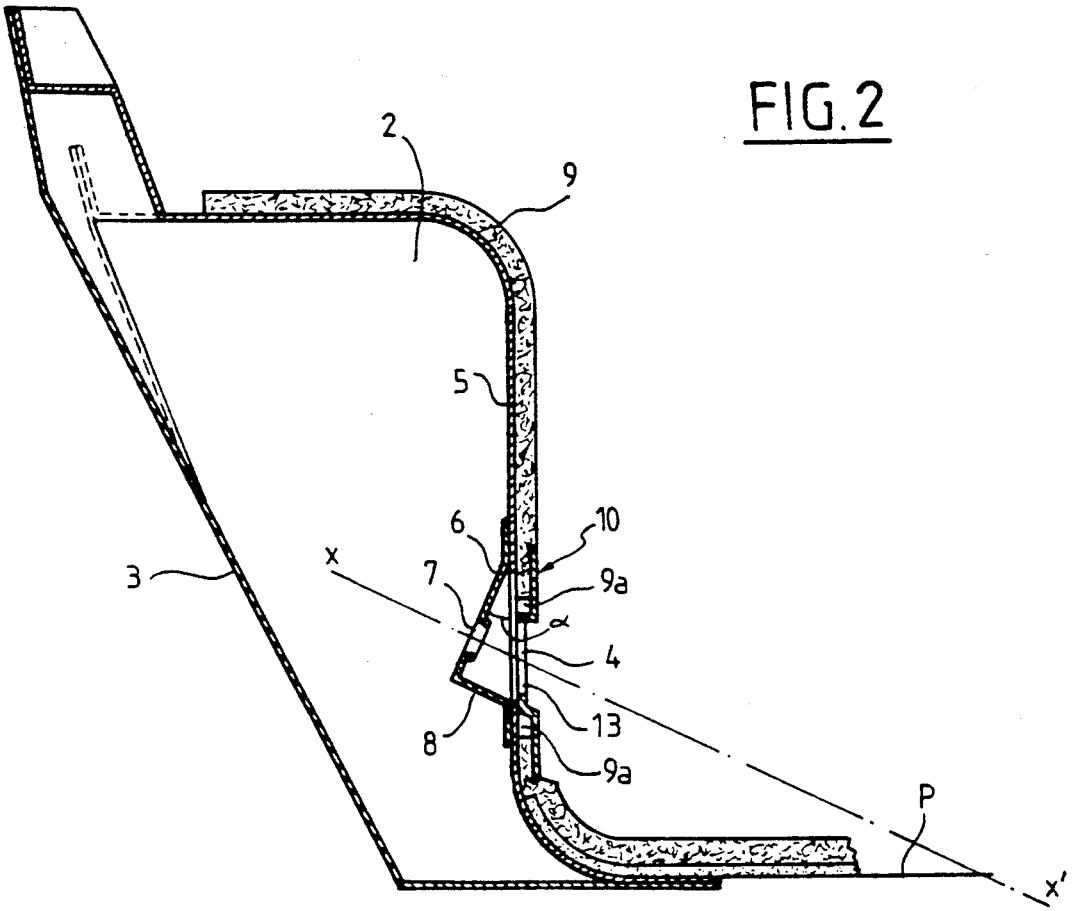
FIG. 2 is a transverse cross sectional view of the conduit which effects distribution of the conditioned air along the length of the vehicle.

Referring to FIGS. 1 and 2, it will be seen that the ventilator 1 injects air previously reheated into the distribution conduit located at the base of the lower internal surface of the vehicle to be air conditioned.

In the example shown in FIG. 1, the distribution of the air to the interior of the vehicle is effected by a series of openings 4 disposed at regular intervals along the conduit 2, on the lateral surface 5 adjacent the interior of the vehicle.

In the transverse cross section of FIG. 2, taken exactly at the level of one of the openings 4 of the conduit, it will be seen that these latter open in the very plane of the lateral surface 5 substantially vertical to the conduit 2, such that no overhang or deflection is present on the external surface of the conduit 2.

This FIG. 2 shows a wall 6 located in the interior of the conduit 2 facing an opening 4. This wall 6 forms an acute angle $\alpha$ with the lateral surface 5 of the conduit 2 and is connected to this latter above the opening 4. Preferably, the inclined wall 6 is part of a profile 8 which extends in the interior of conduit 2, behind the series of openings 4, lengthwise of conduit 2.

Wall 6 has an orifice 7 which faces the opening 4 such that the axis x—x' passing through the respective centers of the orifice 7 and the opening 6 points obliquely both inwardly and toward floor P of the vehicle.

In a preferred embodiment of the invention, the profile 8 comprising a wall 6, has a series of orifices 7 located at regular intervals facing the openings 4 and having a cross section substantially less than that of the openings 4.

Figure 3:
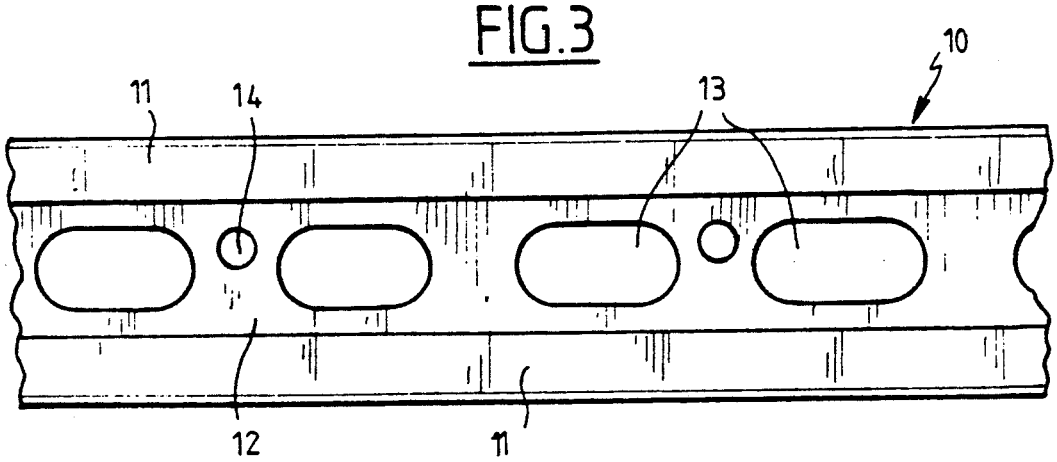
FIG. 3 is an elevational view of a profile for finishing and securing the covering on the conduit.

FIG. 2 also shows the external covering 9 constituted for example by a pile fabric applied to the conduit 2. This covering 9 is discontinuous on opposite sides of the openings 4 to leave free the air outlet passage. The margins 9*a* of this covering 9 are held against the wall 5 of the conduit 2 by securement and finishing means 10. In the embodiment shown in FIGS. 2 to 4, these securement and finishing means comprise a profile whose detailed elevational view is shown in FIG. 3.

This profile 10, which extends the length of the conduit comprises two parallel shoulders 11 adapted to bear against the covering 9 above and below the series of openings 4, and a midportion 12 which bears against the lateral surface 5 of the conduit 2 about the openings 4. This midportion 12 is pierced by a series of windows 13, of a section at least equal to that of the openings 4 provided to give free exit to the conditioned air through the openings 4.

Figure 4:
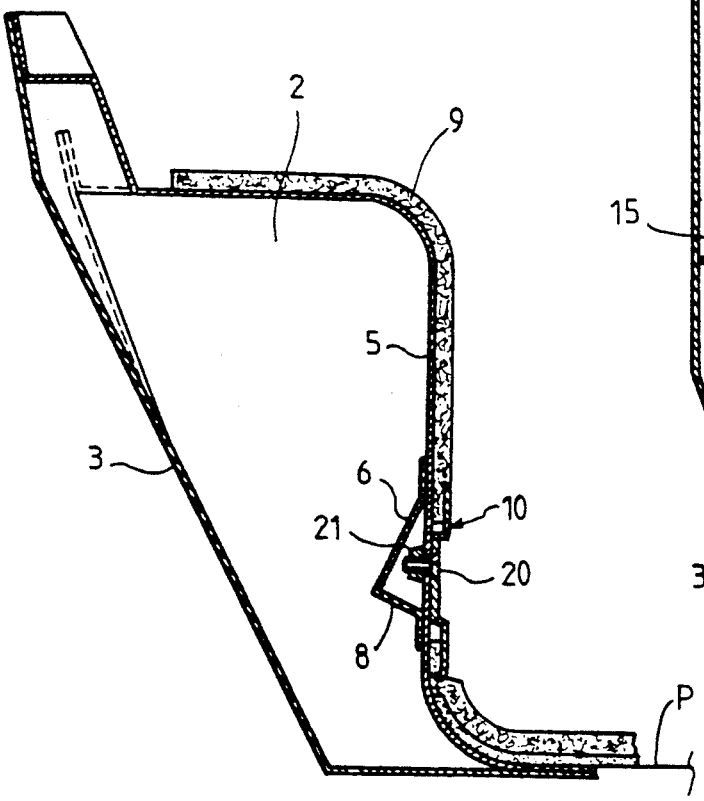
FIG. 4 is another transverse cross sectional view of the conduit.

By way of example and with reference to FIG. 4, the securement of the profile 10 may be by means of a series of screws 20 and caged nuts 21 located at regular intervals along the profile 10 in the midportion 12 which is in contact with the lateral surface 5 of the conduit 2.

In this example, each screw 20 passes through the midportion 12 of the profile 10 by a circular hole 14, and the lateral surface 5 by a hole which is elongated parallel to the profile 10 and cooperates with a caged nut 21 located within the conduit 2.

The arrangement behind the openings 4, of orifices 7 carried by an inclined wall 6, permits injecting the conditioned air in the direction xx' which points both inwardly and toward floor P of the vehicle. This manner of air injection avoids the discomfort of the passenger upon receiving air against the legs as in the case of substantially horizontal injection and also avoids the loss of efficiency due to the flattening of the air jet against the floor in case of substantially vertical injection.

As the orifices 7 are of smaller section than the openings 4, the apparatus permits moreover producing a divergent air jet which upon impact with the floor P covers a larger surface of this latter, which has the effect of improving the homogeneity of the air conditioning.

Thanks to the profile 10, the exterior covering of the conduit is easily integrated with the apparatus. The profile 10 may moreover have the aesthetic properties that are desired.

The system of securing the profile 10 permits easy assembly, given that the troublesome problems associated with adjustment are avoided because of the elongated shape of the holes serving for securement of the profile 10.

Figure 5:
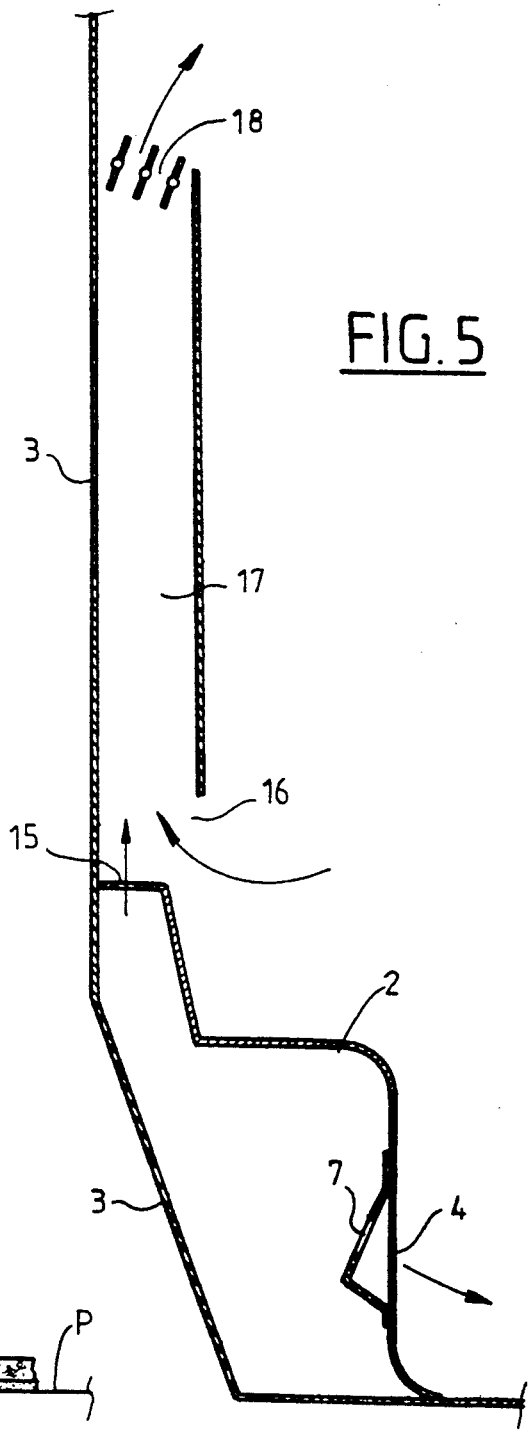
FIG. 5 shows a second embodiment in a cross section transverse to the conduit of the air conditioning apparatus.

In the embodiment shown schematically in FIG. 5, the distribution conduit 2 also has means for distribution of conditioned air upwardly in its upper portion. In particular, the upper surface of the conduit 2 has an ejection orifice 15 which, twinned with an ambient air inlet orifice 16, creates in a compartment 17 adjacent the lateral internal surface 3 of the vehicle, a current of air which is ultimately emitted toward the interior of the vehicle through openings 18.

A device of this nature is described by French patent application 2 632 593 of the applicant.

By the present invention, the air admitted by orifice 16 is taken substantially from the ambient atmosphere and not by reflection from the floor of the air jet produced by the lower portion of the apparatus. There results an improvement of the efficiency of the apparatus.

Of course the invention is not limited to the two embodiments described above. In particular, the series of openings 4 on the lateral surface 5 of the conduit 2 may be replaced by a single slot extending the length of the conduit.

Similarly, it will be evident that the provision of several parallel series of openings 4 on the lateral surface 5 of the conduit does not depart from the scope of the present invention.

I claim:

1. Air conditioning apparatus for vehicles, comprising at least one ventilator (1) blowing cold or reheated air through a conduit (2) extending along a lower portion of an interior lateral surface (3) of the vehicle, said conduit (2) opening into distribution means for the air toward the interior of the vehicle, said distribution means comprising at least one opening (4) provided on a lateral surface (5) of said conduit (2) adjacent the interior of the vehicle, said opening (4) being disposed in a plane which coincides with said lateral surface (5) of the conduit (2), and wherein the interior of the conduit (2) has, facing said opening (4), a wall (6) forming an acute angle $\alpha$ with said lateral surface (5) of the conduit (2) and connected thereto at a point located above said opening (4), said wall (6) comprising at least one orifice (7) facing said opening (4), whereby an axis (x—x') passing through the centers of said orifice (7) and said opening (4) points obliquely both toward the interior and toward the floor (P) of the vehicle.

2. Device according to claim 1, wherein said wall (6) located in the interior of the conduit (2) facing said opening (4) is a portion of a profile (8) extending lengthwise of the conduit (2).

3. Device according to claim 1, wherein said orifice (7) in said wall (6) consists of a series of holes disposed at substantially regular intervals along said wall (6).

4. Device according to claim 3, wherein said opening (4) provided on the lateral surface (5) of the conduit (2) consists of a series of holes disposed at substantially regular intervals lengthwise of the conduit (2).

5. Device according to claim 4, wherein the holes along the lateral surface (5) of the conduit (2) and holes along the wall (6) located in the interior of the conduit (2) face each other.

6. Apparatus according to claim 4, wherein the holes along the wall (6) located in the interior of the conduit (2) have a section smaller than that of the holes located on the lateral surface (5) of the conduit (2).

7. Apparatus according to claim 4, further including an external covering (9) applied to the conduit (2), said conduit having adjacent the opening (4) finishing and securement means for said external covering (9), said finishing and securement means comprising a profile (10) extending lengthwise of the conduit (2) and bearing on opposite sides of the series fo holes on the lateral surface (5) of the conduit (2), against a margin of said external covering (9), and bearing in its midportion (12), against said lateral surface (5) of the conduit (2), a series of windows (13), having a section at least equal to that of the holes present on the lateral surface (5) of the conduit (2), and facing these holes.

8. Apparatus according to claim 7, wherein said profile (10) for finishing and securing the external covering (9) is secured to the lateral surface (5) of the conduit (2) by fastening means passing through holes of elongated shape provided along the lateral surface (5) of the conduit (2).

9. Device according to claim 1, wherein the conduit (2) further includes in its upper portion means for distributing air toward the top of the vehicle comprising an air passage (17), said passage (17) comprising at its base, an opening (16) through which ambient air from the vehicle can enter.

* * * * *